US008635866B2

(12) United States Patent
Schleicht et al.

(10) Patent No.: US 8,635,866 B2
(45) Date of Patent: Jan. 28, 2014

(54) HYDRAULIC SYSTEM

(75) Inventors: Gisela Schleicht, Schwabbruck (DE); Peter Schmied, Schongau (DE); Gerhard Rinninger, Kaufbeuren (DE); Olaf Biedermann, Landsberg am Lech (DE); Gerhard Huber, Frankenhofen (DE); Klaus Stolle, Frankenhofen (DE)

(73) Assignee: Hoerbiger Automotive Komfortsysteme GmbH, Schongau (DE)

( * ) Notice: Subject to any disclaimer, the term of this patent is extended or adjusted under 35 U.S.C. 154(b) by 0 days.

(21) Appl. No.: 13/289,234

(22) Filed: Nov. 4, 2011

(65) Prior Publication Data

US 2012/0073282 A1 Mar. 29, 2012

Related U.S. Application Data

(63) Continuation of application No. PCT/EP2010/001854, filed on Mar. 25, 2010.

(51) Int. Cl.
*F15B 1/26* (2006.01)

(52) U.S. Cl.
USPC ..... 60/472; 60/478

(58) Field of Classification Search
USPC ..... 60/470, 472, 477, 478; 91/485, 503
See application file for complete search history.

(56) References Cited

U.S. PATENT DOCUMENTS

| | | | | |
|---|---|---|---|---|
| 2,586,682 | A | 2/1952 | McLeod | |
| 2,737,899 | A * | 3/1956 | Bonnette et al. | 91/503 |
| 4,011,887 | A | 3/1977 | Raymond | |
| 4,723,576 | A | 2/1988 | Raymond | |
| 5,181,380 | A * | 1/1993 | Favre et al. | 60/478 |
| 5,240,042 | A | 8/1993 | Raymond | |
| 6,435,205 | B1 | 8/2002 | Hattori et al. | |
| 6,520,208 | B2 | 2/2003 | Hattori et al. | |
| 6,626,205 | B2 | 9/2003 | Hattori et al. | |
| 6,945,269 | B2 | 9/2005 | Hattori et al. | |
| 7,055,317 | B2 * | 6/2006 | Knapp et al. | 60/478 |

FOREIGN PATENT DOCUMENTS

| | | |
|---|---|---|
| DE | 10344648 | 4/2004 |
| EP | 1225344 | 9/2006 |
| WO | 2007/019040 | 2/2007 |

* cited by examiner

*Primary Examiner* — F. Daniel Lopez
(74) *Attorney, Agent, or Firm* — Myers Wolin, LLC

(57) ABSTRACT

A hydraulic system, especially in a high-pressure application, comprises a pressurized-fluid tank, a pressurized-fluid pump driven by a drive unit, at least one hydraulic load that can be pressurized thereby and a control and/or distribution unit connected fluidically between the pressurized-fluid pump and the load. This unit is provided with a housing and a core received therein and connected rigidly with the housing, which core bears with part of its surface in the region of a common, closed, especially cylindrical joint face with the housing on a corresponding inside face of a housing opening. Surface groove-like flow ducts are provided on the core and/or the housing in the region of the joint face, and the pressurized-fluid pump is directly built onto the control and/or distribution unit in the region of a free end face of the core.

22 Claims, 7 Drawing Sheets

HYDRAULIC SYSTEM

CROSS REFERENCE TO RELATED APPLICATIONS

The present application is a continuation of PCT/EP2010/001854 filed on Mar. 25, 2010, which claims priority to German Patent Application No. 10 2009 019 721.4, filed 5 May 2009, the contents of each of which are incorporated herein by reference.

FIELD OF THE INVENTION

The present invention relates to a hydraulic system, comprising a pressurized-fluid tank, a pressurized-fluid pump driven by a drive unit, at least one hydraulic load that can be pressurized thereby and a control and/or distribution unit connected fluidically between the pressurized-fluid pump and the load.

BACKGROUND

Such hydraulic systems (see, for example, U.S. Pat. No. 7,055,317 B1) are known and being used in diverse embodiments for various applications. For example, they are applied in motor vehicles, especially for actuation of convertible tops. In this respect, DE 10344648 A1 is an example of the pertinent prior art.

Especially for hydraulic systems for the foregoing application, increasingly greater demands are being made on the structural size and the weight, to the effect that the installation space for the hydraulic aggregate, meaning the unit comprising the pressurized-fluid tank, the pressurized-fluid pump and the motor driving it, is becoming extremely restricted in an increasing number of cases, and the hydraulic system on the whole must have particularly lightweight construction. In some cases, and to a certain extent, the structural size—for given system power—can be reduced by increasing the operating pressure. In turn, however, sealing problems may result, especially in view of the fact that the temperature to which the hydraulic system is exposed in a motor vehicle may undergo very large fluctuations. Precisely for convertible tops, however, even the slightest leak of the system cannot be tolerated.

SUMMARY

Against the background of the problems described in the foregoing, the object of the present invention is to provide a hydraulic system of the type mentioned in the introduction that, for a given power, is characterized in the same way by a particularly small structural size and a particularly light weight and also satisfies further requirements applicable specifically in automotive engineering, such as particularly low noise generation, low manufacturing costs, high reliability, low maintenance expense, long useful life and minimum leakage risk.

Accordingly, in order to cope with what have been shown to be extremely diverse problems, the inventive hydraulic system—which is suitable and designed especially for high-pressure applications—is characterized by a large number of characteristic features, matched to one another by considering a combinatorial functional interaction. Worth emphasizing in this respect is in particular the combination of the specific embodiments of the control and/or distribution unit and the specific connection of the pressurized-fluid pump to precisely this control and/or distribution unit. In the manner known in itself (see U.S. Pat. No. 4,011,887 A, EP 1225344

B1, U.S. Pat. No. 6,435,205 B1, U.S. Pat. No. 6,520,208 B2, U.S. Pat. No. 6,626,205 B2, U.S. Pat. No. 6,945,269 B2, WO 2007/019040 A2 and U.S. Pat. No. 4,723,576 A), this unit is provided with a housing and a core received therein and connected rigidly (for example by means of a shrink fit) with the housing, which core bears with part of its surface in the region of a common, closed, especially cylindrical joint face with the housing on a corresponding inside face of a housing opening, surface groove-like flow ducts being provided on the core and/or the housing in the region of the joint face. The pressurized-fluid pump is directly built onto this control and/or distribution unit, specifically in the region of a free end face of the core in the present invention. In this way there is achieved a hydraulic system with a previously unknown combination of favorable properties, making the inventive hydraulic system particularly suitable for a large number of applications, especially diverse high-pressure applications. In particular, the following properties are to be emphasized: Compared with known hydraulic systems of the same power that have been proved in practice, the hydraulic system according to the present invention is particularly compact and lightweight. The installation space needed for the hydraulic aggregate including built-on control and/or distribution unit is approximately 40% smaller than in the case of known hydraulic systems of the same power that have been proved in practice. The same is true for the weight. Thus not only is it possible to dispose even complex shapes of flow ducts plus associated control components (valves, etc.) in the smallest space in the control and/or distribution unit, but also it is possible to configure the flow ducts in question especially favorably in terms of fluid flow, especially by eliminating flash and other more or less sharp-edged irregularities that are unavoidable, especially in the case of several bores having portions not aligned with one another. Not only is this advantageous for the performance of the hydraulic system, but also it is possible in this way to prevent the generation of flow noise. The reliability of the hydraulic system benefits from the fact that the flow ducts of the control and/or distribution unit can be produced by surface machining of the core before it is inserted in the housing, especially by indentations produced without metal cutting or even by appropriate milling in the later joint face between core and housing, since chips resulting from surface milling can be reliably removed, in contrast to the case for bores with several portions not aligned with one another. This in turn is also advantageous in terms of a smaller maintenance expense and a longer useful life. By application of the present invention, not only are the manufacturing costs lower merely by virtue of the comparatively smaller material usage than in known hydraulic systems of the same power that have been proved in practice, but also the simplified machining processes help to reduce the costs, as does the significant reduction of the necessity to seal auxiliary bores that are usual in the prior art, since these auxiliary bores to be sealed further represent a potential leakage risk, precisely in high-pressure applications. Maximum safety against leakage even in the case of the highest system pressures (up to 200 bar or even higher) is achieved both inside the control and/or distribution unit and in the region of the attachment of the pressurized-fluid pump thereto. Considering all of these properties, there is achieved a hydraulic system of previously unknown fitness for diverse practical applications.

According to a first preferred improvement of the invention, it is particularly favorable in view of the properties shown in the foregoing when the pressurized-fluid pump projects at least partly, preferably completely into the control and/or distribution unit. Not only is this particularly advantageous in terms of the structural size of the hydraulic aggregate, which in such a case can be of particularly compact construction, but also, in such an improved hydraulic system, absolutely reliable sealing of the pressurized-fluid pump relative to the control and/or distribution unit is possible at the circumference of the portion of the pressurized-fluid pump projecting into the control and/or distribution unit, or in other words especially what is known as the pump flange, even with minimum complexity. In particular, this pressurized-fluid pump can project at least partly, preferably completely into a seat disposed at an end face of the core of the control and/or distribution unit, thus ensuring that the pressure port of the pressurized-fluid pump is in direct communication with a corresponding bore in the core of the control and/or distribution unit. In this case the pressurized-fluid pump is preferably sealed relative to the core of the control and/or distribution unit at the circumference of the portion projecting into the seat of the core of the control and/or distribution unit. From the viewpoint of minimum leakage risk, it is even more favorable for the pump flange projecting into the control and/or distribution unit to be sealed relative to the housing of the control and/or distribution unit at the circumference of this flange.

Within the scope of the present invention, and depending on the specific application of the corresponding hydraulic system, it is possible to use different pressurized-fluid pumps advantageously. For diverse typical applications, however, a particularly favorable embodiment of the pressurized-fluid pump is as a slit-controlled radial-flow piston pump, since in this case the aforesaid advantages of the invention are particularly pronounced.

This is the case analogously when—according to yet another preferred improvement of the invention—a pressurized-fluid container containing the pressurized-fluid tank and disposed opposite the pressurized-fluid pump in the region of a second free end face of the core is built directly onto the control and/or distribution unit. For this purpose in particular, the core of the control and/or distribution unit can project out of the housing of the control and/or distribution unit at least adjacent to its second end face, the pressurized-fluid container being fastened to the end portion of the core projecting out of the housing of the control and/or distribution unit. For this purpose, a profiled structure, for example in the form of a groove, can be provided on the core to facilitate attachment of the pressurized-fluid tank. In view of a minimum leakage risk, it is particularly favorable as an alternative when the housing of the control and/or distribution unit is provided on its second end portion opposite the pressurized-fluid pump with an annular shoulder, on which the pressurized-fluid container is fastened. In particular, but not exclusively, it is possible in this case for the second end face of the core to be retracted relative to the housing of the control and/or distribution unit, so that at least part of the volume of the pressurized-fluid tank is disposed adjacent to the second end face of the core inside the housing of the control and/or distribution unit. Thus, in an advantageous improvement, a return-flow line placing the at least one load in communication with the pressurized-fluid tank, while passing directly through the housing of the control and/or distribution unit, can open into the part of the volume of the pressurized-fluid tank disposed inside the housing of the control and/or distribution unit.

Nevertheless, the arrangement explained in the foregoing for the pressurized-fluid tank or for a pressurized-fluid container containing it on the end portion of the control and/or distribution unit opposite the pressurized-fluid pump is in no way obligatory. To the contrary, given appropriate space conditions, other arrangements of the pressurized-fluid tank may prove more favorable, for example on one side of the control and/or distribution unit at an angle to the pressurized-fluid pump or else adjacent thereto on the first end portion of the control and/or distribution unit.

According to another preferred improvement of the present invention, the pressurized-fluid tank is disposed spatially inside the control and/or distribution unit, specifically by the fact that the control and/or distribution unit is provided with a second core in addition to the (first) core already explained in the foregoing, the two cores being inserted in the housing opening at a distance from one another and the space bounded by the housing opening and the oppositely disposed end faces of the two cores forming the pressurized-fluid tank. In this way there is no need to manufacture a separate component in the form of the separate pressurized-fluid container, and the arrangement of two cores inside the housing of the control and/or distribution unit permits increased flexibility with regard to the arrangement and configuration of the flow ducts, as is advantageous for certain applications. Once again, a return-flow line placing the at least one load in communication with the pressurized-fluid tank and passing directly through the housing of the control and/or distribution unit can then open into the pressurized-fluid tank disposed inside the housing of the control and/or distribution unit.

According to another particularly preferred improvement of the invention, especially in the case of use of the inventive hydraulic system for extremely high pressure and/or extremely clean room applications, there are provided, in the region of the joint face, relief channels disposed circumferentially on the core and/or housing at both ends outside the portion provided with flow ducts, which channels communicate with a return-flow bore opening into the pressurized-fluid tank. In this way, emergence of pressurized fluid from the control and/or distribution unit in the region of the end faces of the core is prevented absolutely reliably with minimum complexity. The said return-flow bore may then be disposed in the core, especially substantially centrally therein. It may be a common return-flow bore, in which case a functional insert, such as a return-flow filter, may be disposed in the return-flow bore in the region of the core of the control and/or distribution unit. The substantially central arrangement of the return-flow bore in the core described in the foregoing also proves to be advantageous from the viewpoint that the core can be provided in this case with bores, especially radial bores, that place bores disposed in the core and receiving valve devices in communication with the common return-flow bore. The said bores receiving valve devices may then extend inside the core, especially substantially axially, and in fact, preferably distributed around the central return-flow bore.

In yet another preferred improvement of the invention, however, and also independently of the arrangement of a possible return-flow bore explained in the foregoing, the core of the control and/or distribution unit is provided with bores extending in longitudinal direction and receiving valve devices. According to an advantageous improvement, if the said bores pass through the core from the one, first end face to the opposite other, second end face, even complex valve devices can be mounted in the core, by inserting associated components from both end faces into the corresponding bores. Especially in this case, it is possible to provide, at one end face at least of the core, a common sealing and retaining device extending through a large number of receiving bores, preferably comprising a large number of mutually independent sealing plugs inserted into the receiving bores and a common retaining washer securing them in position. As an example, this washer may be secured in position on the core by means of one or more bolts. Other known forms of securing the position may also be considered, such as a flare joint.

Furthermore, the core of the control and/or distribution unit can be provided with bores passing through it, extending transverse to its longitudinal direction, radially or tangentially, in which bores there are received valve devices. It is then particularly favorable if the bores extending transverse to the longitudinal direction of the core communicate with longitudinal bores, which in turn can receive valve devices; this makes it possible to dispose even complex hydraulic connections in the narrowest space. Against the same background, it is favorable if at least two surface groove-like flow ducts separated from one another in the region of the joint face can communicate with one another constantly via a bore passing through the core, since this then provides greater flexibility of design with regard to the arrangement and routing of the surface groove-like flow ducts, without causing them to hinder one another. The same may be true in the individual case if, according to another preferred improvement of the invention, groove-like flow ducts are provided in the region of the joint face both on the core and on the housing.

Furthermore, within the scope of the present invention, it is possible and particularly favorable that at least one of the surface groove-like flow ducts has a well-defined cross-sectional constriction, especially a throttling gap. Throttling gaps necessary for certain applications of inventive hydraulic systems can be made with high precision and good reproducibility and with minimum complexity in this case also.

Again in the interest of optimum sealing of the core and/or distribution unit against its housing with minimum structural complexity, the core and the joint face have substantially plain cylindrical shape, since this favors uniformly firm, tight bearing of the housing of the control and/or distribution unit against the core, when these parts are joined to one another by means of a shrink fit. Against the same background, another preferred improvement of the invention is characterized in that at least one port block, which is molded in one piece onto the side of the housing of the control and/or distribution unit and in particular acts to connect the at least one load to the control and/or distribution unit, is joined over only part of the length of the joint face to the shell portion of the housing surrounding the joint face. In particular, this at least one port block may have shorter axial length than the shell portion, so that the shell portion projects axially at both ends beyond the at least one port block. Hereby identical or at least very similar wall thicknesses can be achieved over the circumference in the region of the end portions of the shell portion, thus permitting a correspondingly homogeneous stress distribution in a housing shrunk onto the core, at least at the end faces. If for structural reasons it is not possible for the at least one port block of the housing of the control and/or distribution unit to have shorter axial length than its shell portion, a substantially comparable result can be achieved if the housing of the control and/or distribution unit is provided with a stress-relief groove between the shell portion and the port block, at least in the region of its end faces. From comparable viewpoints, it is advantageous when reinforcements of the housing acting as the screwed coupling of the pressurized-fluid pump with the housing of the control and/or distribution unit are set back relative to the associated end face of the housing.

Preferably all electrically actuated or activated components of the control and/or distribution unit, especially all solenoid valves, are also mounted in the at least one port block, explained in the foregoing, molded in one piece onto the side of the housing of the control and/or distribution unit. In this way there is no need for electrical control lines to the core of the control and/or distribution unit. Furthermore, a manually actuated valve device—known in itself—is preferably mounted on the at least one port block, which device can be actuated specifically for the purpose of manual operation of the component to be actuated by the load of the hydraulic system in case of failure or defect of the electrical periphery.

Again in the interest of a particularly compact embodiment of the hydraulic system according to the present invention, angled bores can be disposed in the region of the port block, a partial portion of the respective bore being drilled from the housing opening while a further partial portion, with which the associated partial portion drilled from the housing opening intersects, can be drilled from the end face of the port block, from its longitudinal side or if necessary also from the connection side. This permits a high packing density of the bores needed in the port block, without the possibility that auxiliary bores, which again would be difficult to seal, would have to be provided later.

Finally, in view of minimum manufacturing costs, it is particularly favorable if the housing of the control and/or distribution unit—by means of appropriate chip-removing machining—is manufactured from a blank prefabricated by extrusion or else casting.

BRIEF DESCRIPTION OF THE DRAWINGS

The present invention will be explained in more detail hereinafter on the basis of a preferred exemplary embodiment and two modifications thereof illustrated in the drawing, wherein.

DETAILED DESCRIPTION

Figure 1:
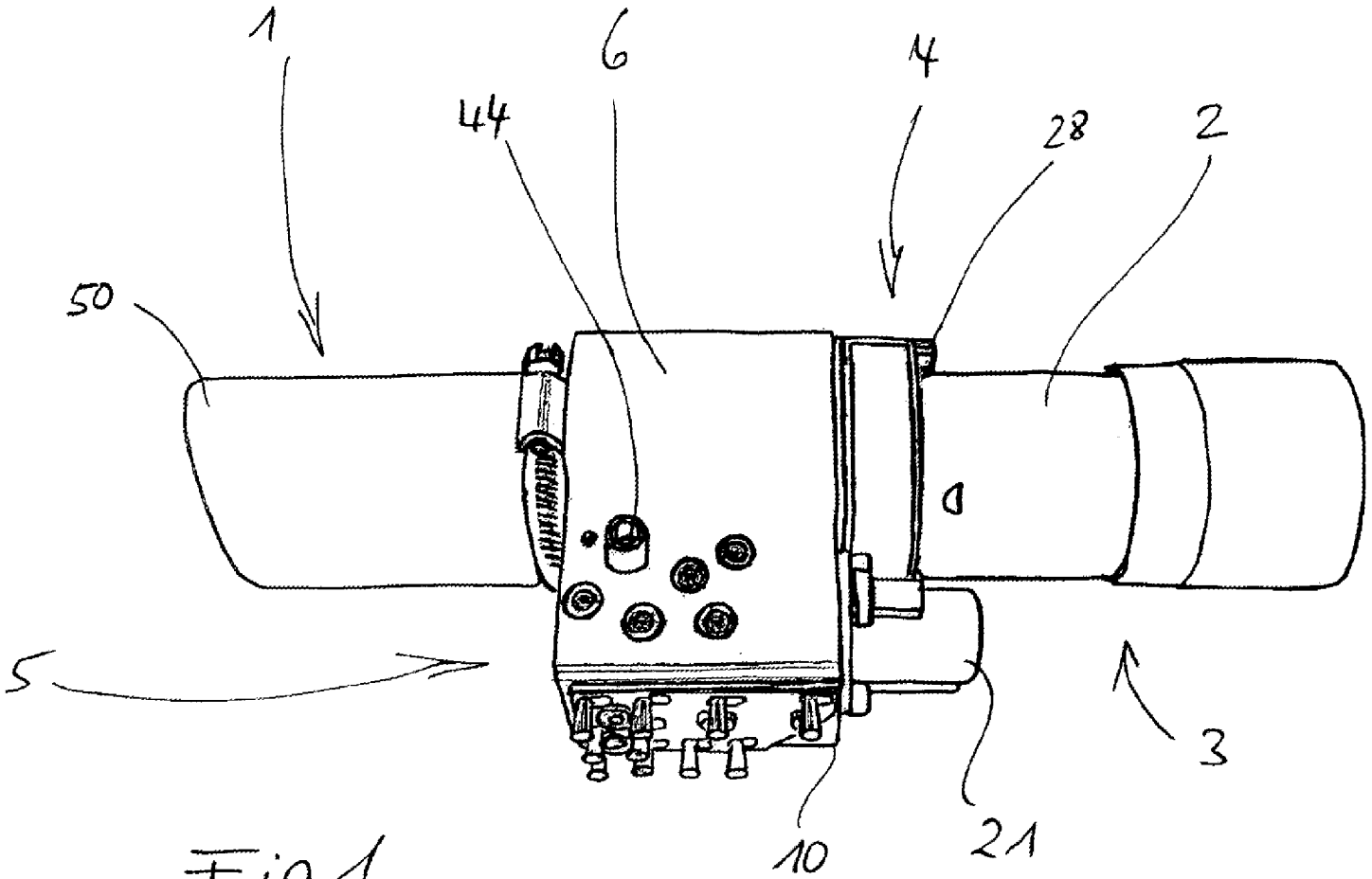
FIG. 1 shows a hydraulic aggregate, comprising a pressurized-fluid tank, a drive motor, a pressurized-fluid pump driven thereby and a control and distribution unit, of a hydraulic system according to the present invention.
Figure 2:
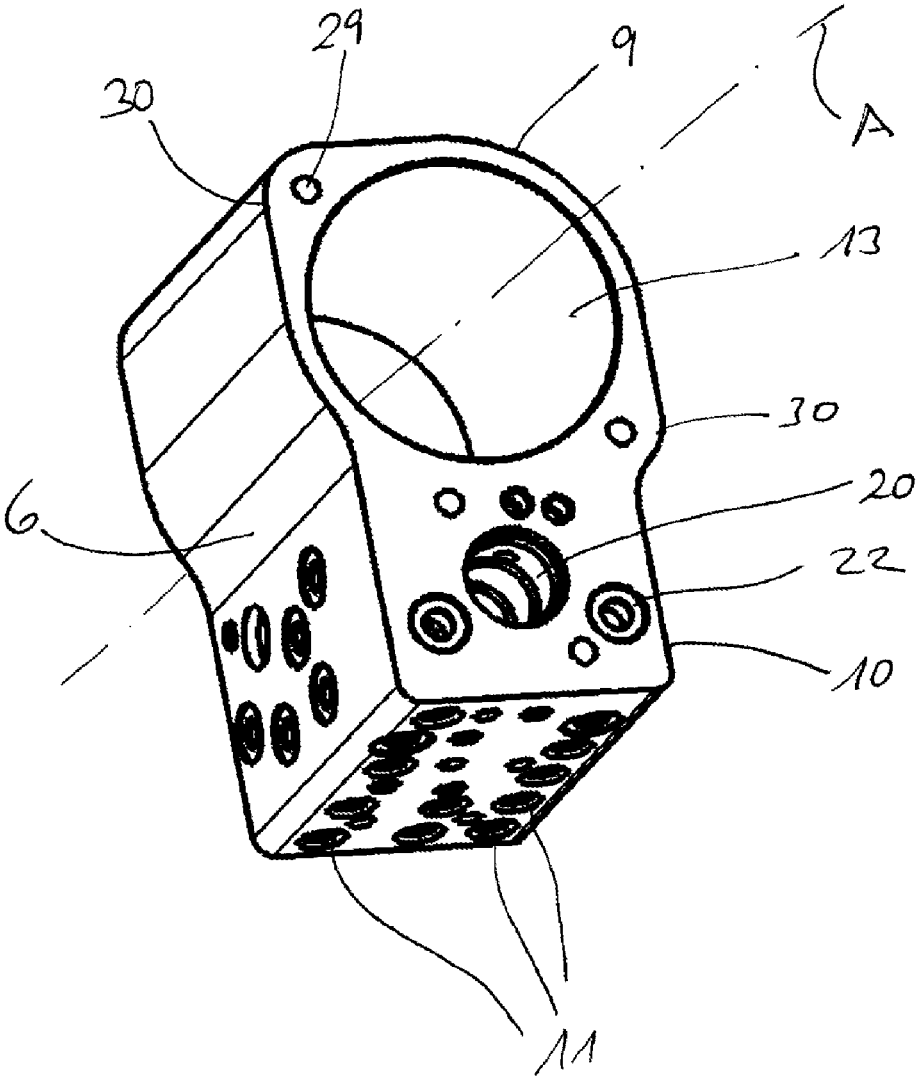
FIG. 2 shows the housing of the control and distribution unit of the hydraulic aggregate shown in FIG. 1 from a first elevation view, specifically from the pump side.
Figure 3:
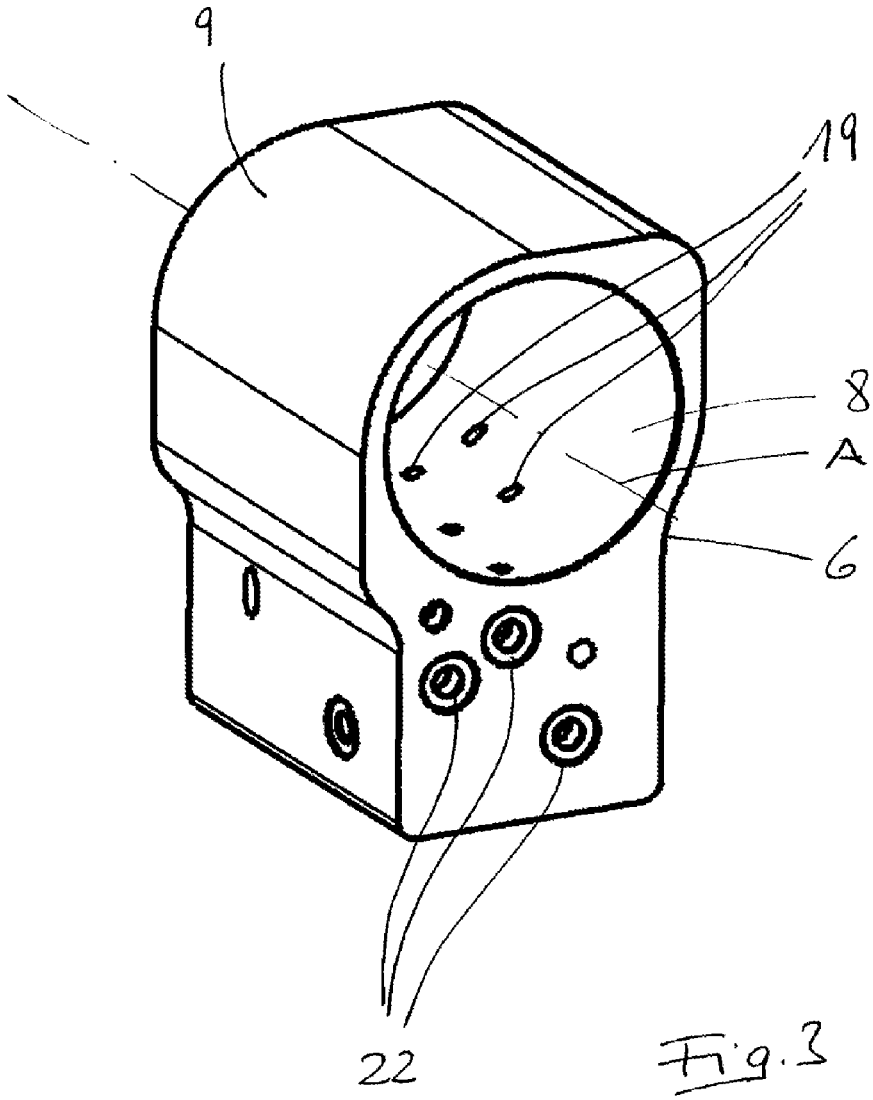
FIG. 3 shows the housing of the control and distribution unit of the hydraulic aggregate shown in FIG. 1 from a second elevation view, specifically from the tank side.
Figure 4:
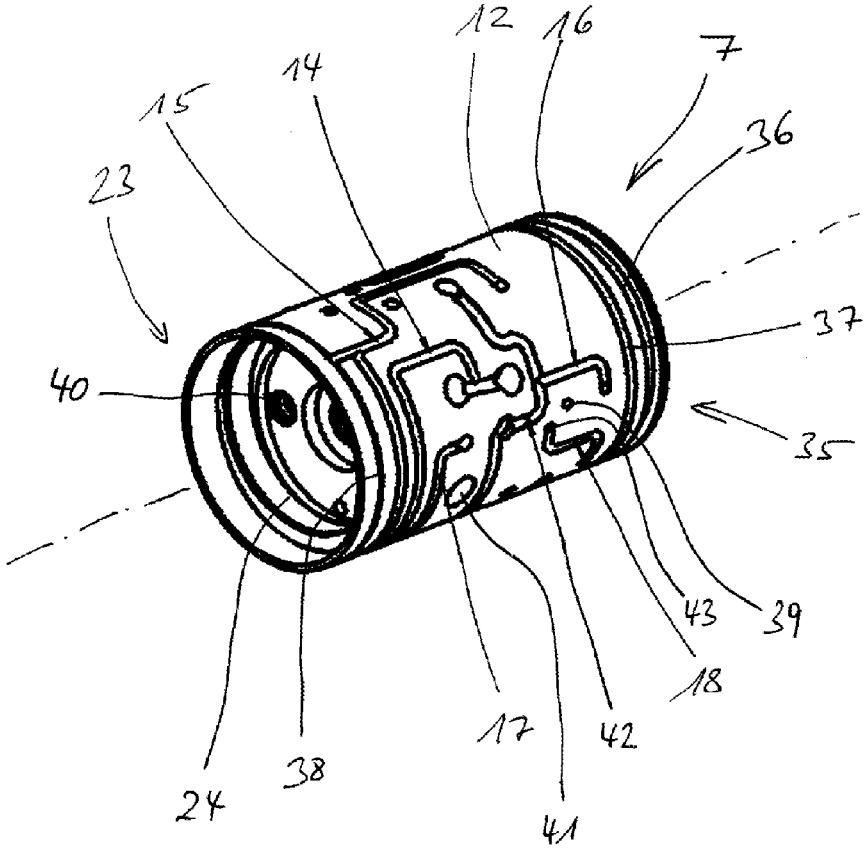
FIG. 4 shows the core of the control and distribution unit of the hydraulic aggregate shown in FIG. 1.
Figure 5:
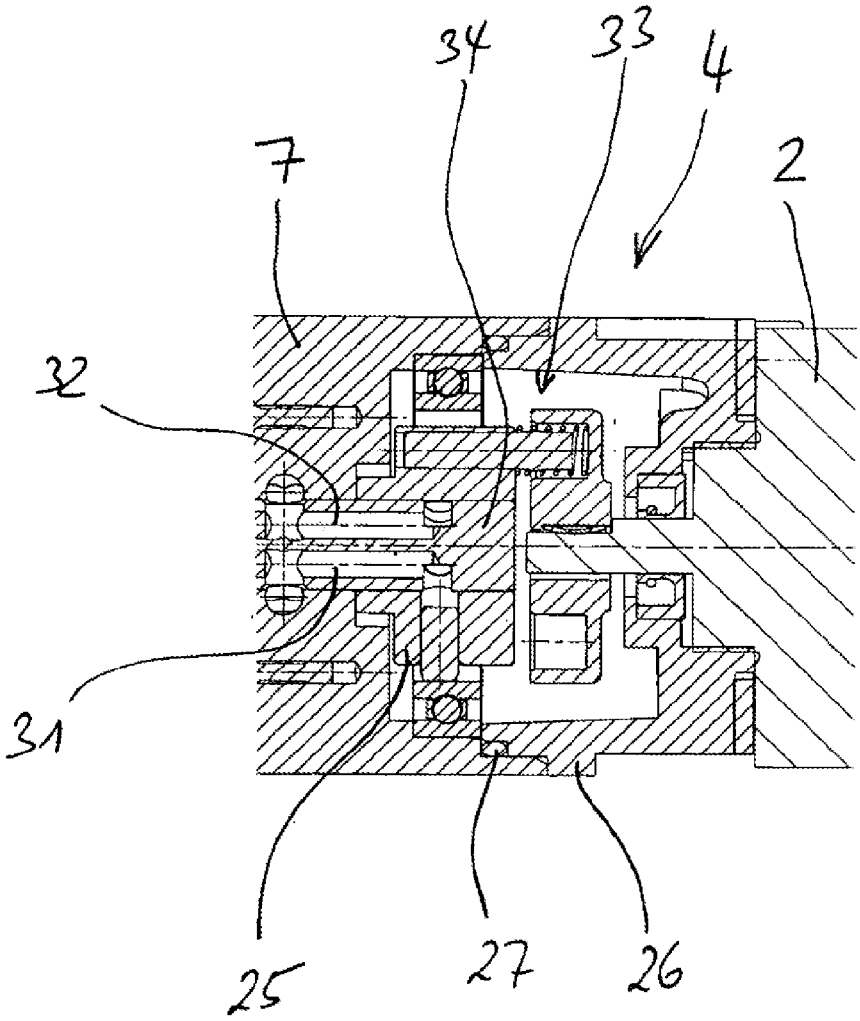
FIG. 5 shows an axial section through the pressurized-fluid pump.

The hydraulic aggregate illustrated in the drawing, which is provided for a hydraulic system, not shown in more detail, operating with high pressures (approximately 200 bar) and intended for actuation of a convertible top, comprises a pressurized-fluid container 50 containing pressurized-fluid tank 1, a drive motor 3 designed as an electric motor 2, a pressurized-fluid pump 4 driven thereby and a control and distribution unit 5 disposed between pressurized-fluid container 50 and pressurized-fluid pump 4. Control and distribution unit 5 in turn comprises two main components, namely a housing 6 and a core 7 joined rigidly to the housing. Core 7 has substantially cylindrical shape; it is received in a housing opening 8 extending through housing 6 along axis A. In addition to shell portion 9 surrounding housing opening 8, the housing comprises a port block 10 molded in one piece onto the side thereof. This is provided with ports 11 designed in a manner known in itself, via which the hydraulic loads designed as hydraulic cylinders can be connected to control and distribution unit 5. Housing 6 of control and distribution unit 5 is manufactured by chip-removing machining from a blank prefabricated by extrusion.

The rigid connection of housing 6 with core 7 is achieved by means of a shrink fit, in the sense that core 7 bears with part of its surface 12 on a corresponding inside face 13 of housing opening 8 in the region of a common, closed cylindrical joint face with housing 6. In the region of the joint face, surface groove-like flow ducts 14, 15, 16, 17, 18 are provided on the core. Some of these communicate with bores 19 opening into housing opening 8. Some of these bores 19 in turn are in direct communication with a respective port 11 associated with them; other bores 19 communicate with hydraulic control devices or components mounted in port block 10, such as a solenoid valve 21 inserted in receiving bore 20 or check, shuttle or pressure-limiting valves inserted in further receiving bores 22. As regards the further components mounted in port block 10, some of bores 19 opening from ports 11 directly into housing opening 8 are angled, since these bores are drilled from the port side and from the housing opening along axes angled relative to one another.

Pressurized-fluid pump 4 designed as a slit-controlled radial-flow piston pump is built directly onto control and distribution unit 5 in the region of one free, first end face 23 of core 7. For this purpose core 7 is provided at its first end face 23, where it is closed off substantially flush with housing 6 of control and distribution unit 5, with a seat 24, which receives rotor 25 of pressurized-fluid pump 4. Housing 26 of the pressurized-fluid pump also projects into seat 24 of core 7 and at its circumference is sealed relative to the core by means of seal ring 27. Housing 26 of pressurized-fluid pump 4 is fastened by means of two bolts 28, which engage in corresponding threaded bores 29 of housing 6 of control and distribution unit 5. In the region of threaded bores 29, housing 6 is provided with reinforcements 30. The two ports 31 and 32 of pressurized-fluid pump 4 driven by electric motor 2 via a clutch 33 are constructed in a hub 34 inserted sealingly in the core. The radial-flow piston pump itself corresponds to a design known in itself, and so further explanations are unnecessary.

Core 7 has a greater axial length than does shell portion 9 of housing 6. At its second end face 35, or in other words on the tank side, it projects out of the housing. The pressurized-fluid container is fastened to the corresponding projection of core 7. For this purpose a circumferential groove 36 is provided on the associated end portion of the core, so that corresponding claws of the nozzle of the pressurized-fluid container seated on the core can engage therein.

In the region of the joint face, core 7 is provided, at both ends outside the portion provided with flow ducts 14-18, with circumferential relief channels 37, 38, which communicate with a return-flow bore opening into pressurized-fluid tank 1. This return-flow bore is disposed substantially centrally in core 7 and opens directly into pressurized-fluid tank 1. A return-flow filter is disposed in that bore. The valve devices received in axial receiving bores 40 of the core are also connected to the return-flow bore via radial bores 39 extending from outside face 12 of the core into the central return-flow bore. Some of the axial receiving bores of the core pass through the core from the one, first end face 23 to the opposite other, second end face 35, thus permitting installation of components of the valve devices inserted in the corresponding receiving bores 40 from both end faces of core 7.

Furthermore, core 7 is provided with tangentially extending bores 41, in which there are received valve devices disposed between two drilled axial receiving bores 40. And surface groove-like flow duct 16 is provided with a well-defined cross-sectional constriction 42 in the form of a throttling gap. And surface groove-like flow duct 18 is constantly in communication with a further groove-like flow duct, not shown, via a connecting bore 43 passing through the core.

A manually actuated valve device is mounted in port block 10. For this purpose a shaft 44, to which a handle can be attached, projects out of port block 10.

Figure 6:
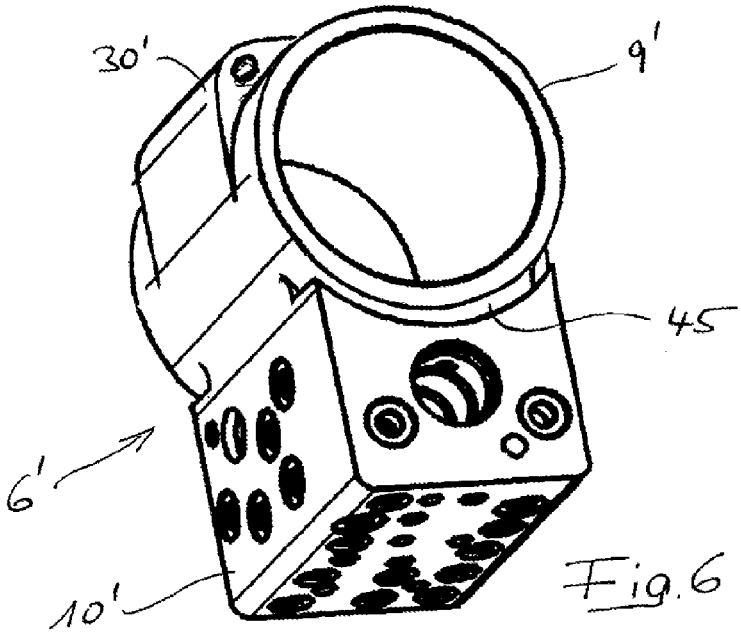
FIG. 6 shows a housing modified compared with the embodiment according to FIGS. 1 to 5.

Housing 6' of the control and distribution unit shown in FIG. 6, as a modification of the embodiment explained in the foregoing with reference to FIGS. 1 to 5, is characterized by two special features. Firstly port block 10' is joined only over part of the length of the joint face to shell portion 9', by the fact that housing 6' of the control and/or distribution unit is provided in the region of its two end faces with respective stress-relief grooves 45 between shell portion 9' and port block 10'. And also reinforcements 30' extend only over part of the length of shell portion 9', by the fact that they are set back from the respective end faces of housing 6'. In this way shell portion 9' has substantially constant wall thickness in the region of its two end faces, so that particularly uniform shrinkage stresses prevail here, thus favoring particularly reliable sealing of the core against housing 6'.

Otherwise the explanations for the embodiment according to FIGS. 1 to 5 apply analogously for housing 6' according to FIG. 6, and so there is no need to repeat them here.

Figure 7:
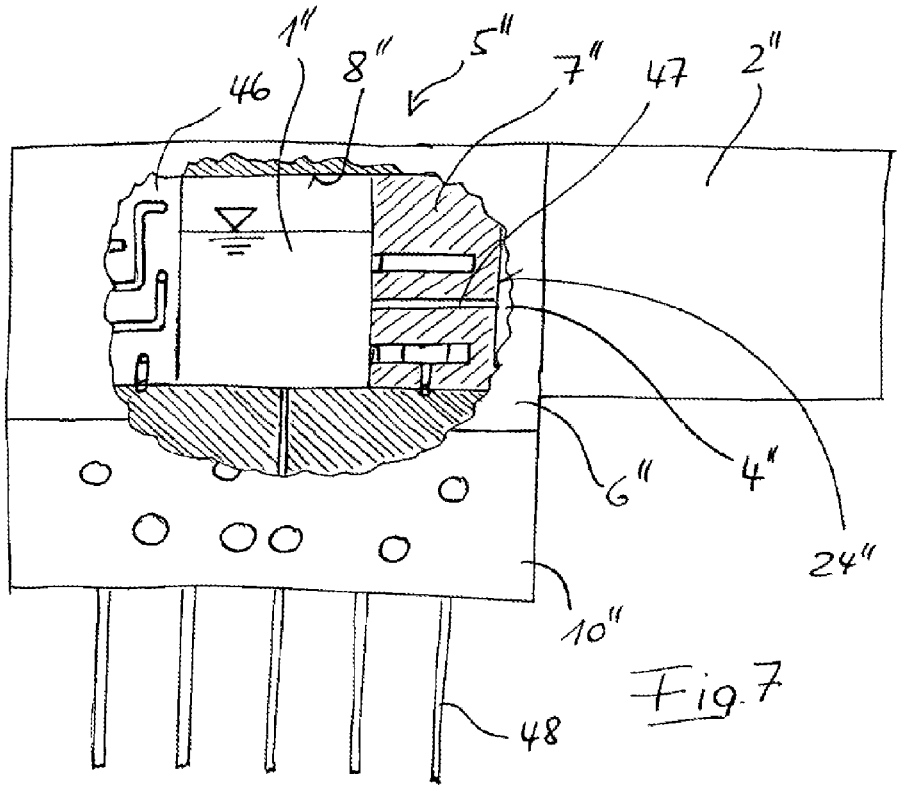
FIG. 7 schematically illustrates a modified control and distribution unit with two cores and internal pressurized-fluid tank.

The hydraulic aggregate illustrated schematically in FIG. 7, as a modification compared with the embodiment explained hereinabove with reference to FIGS. 1 to 5, is characterized in that control and/or distribution unit 5" is provided with two cores, namely a first core 7" (illustrated in section) and a second core 46 (not illustrated in section). The two cores 7" and 46 are received in housing opening 8" of housing 6" in such a way that they are spaced apart from one another. The space bounded between the two cores 7" and 46 of housing opening 8" of housing 6" forms pressurized-fluid tank 1". Pressurized-fluid pump 4" driven by electric motor 2" is in communication therewith via suction line 47 passing through first core 7". The surface flow ducts provided on second core 46 and/or internals disposed in the second core can be connected to the pressure side of pressurized-fluid pump 4", for example via at least one line (not illustrated) passing through port block 10". For this purpose, however, it is also possible to consider, for example, a pressure line extending between the two cores 7" and 46 and passing through pressurized-fluid tank 1". Finally, FIG. 7 also shows connecting lines 48, which are connected in a manner known in itself to port block 10".

Figure 8:
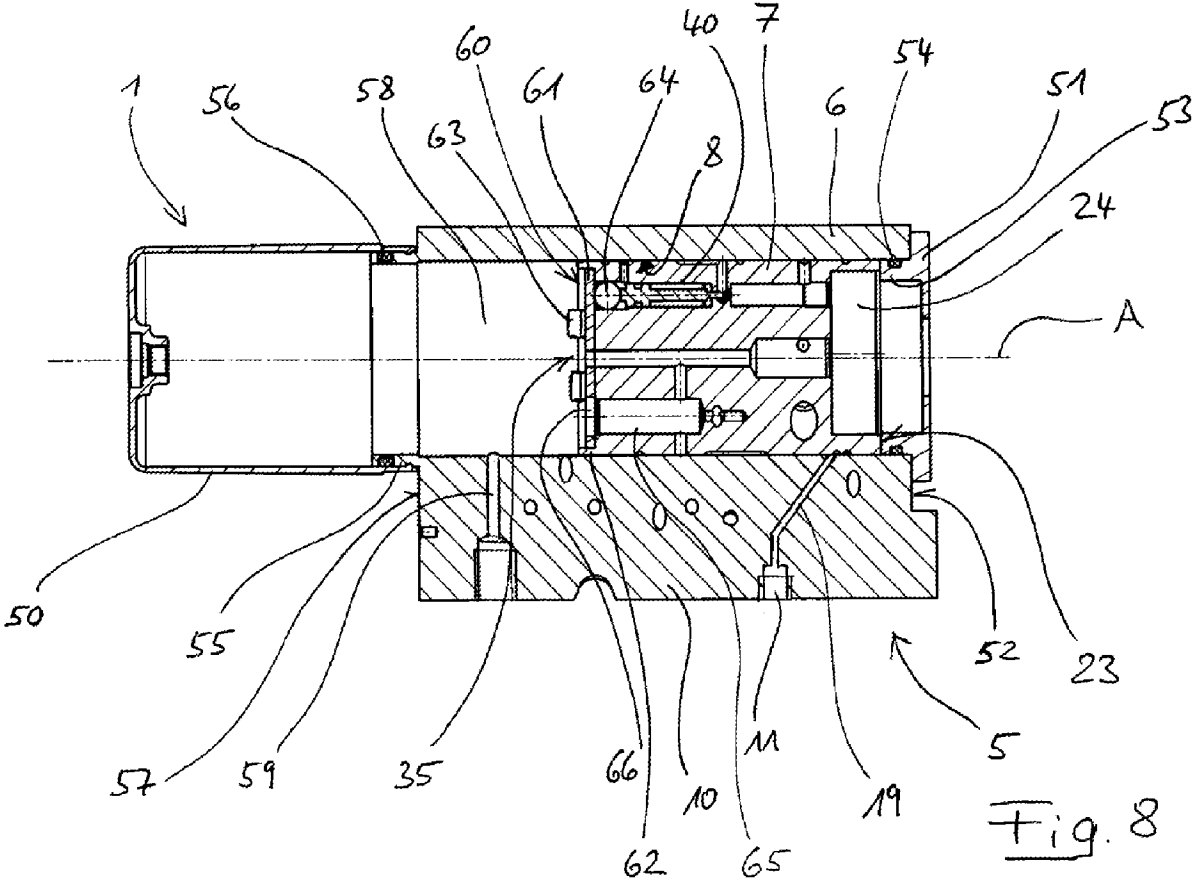
FIG. 8 illustrates, on the basis of a further exemplary embodiment of a control and distribution unit with pressurized-fluid container built onto it, various modifications compared with the exemplary embodiment according to FIGS. 1 to 5.

The embodiment of a control and distribution unit 5 shown in FIG. 8 together with pressurized-fluid container 50 built onto it and containing pressurized-fluid tank 1 is explained substantially from the foregoing explanations of the embodiment according to FIGS. 1 to 5, and so these will not be repeated. However, the following relevant differences are to be pointed out:

Pump flange 51 of the pressurized-fluid pump—not otherwise illustrated—indeed projects into housing 6 of control and distribution unit 5, but not into its core 7. First end face 23 of core 7 disposed opposite the pump is therefore set back accordingly relative to associated first end face 52 of housing 6 of control and distribution unit 5. At the circumference of its portion 53 projecting into housing 6 of control and distribution unit 5, pump flange 51 is sealed relative to housing 6 of control and distribution unit 5 by means of ring seal 54.

Furthermore, pressurized-fluid container 50 is fastened to an annular shoulder 55, which is molded onto housing 6 of control and/or distribution unit 5, at the end portion thereof opposite the pressurized-fluid pump. Once again, reliable sealing of the entire hydraulic aggregate relative to the outside is achieved in structurally simple manner by means of a ring seal 56. At its second end facing away from the pressurized-fluid pump, core 7 of control and distribution unit 5 is retracted relative to associated end face 57 of the housing, whereby a space 58, which is in communication with pressurized-fluid container 50 and forms part of pressurized-fluid tank 1, is defined inside housing 6. Into this space 58 there opens a return-flow line 59 passing through housing 6 of control and distribution unit 5, whereby the at least one load (not illustrated) is in direct communication with pressurized-fluid tank 1. Furthermore, there is illustrated an angled bore 19, which is disposed in port block 10 and was drilled from the port side and from housing opening 8.

Finally, a common sealing and retaining device 60 extending over a large number of receiving bores 40 is illustrated at second end face 35 of core 7. This comprises a retaining washer 61, which is received in a centering ring 62 of core 7 and is fixed to core 7 by means of two bolts 63, and a large number of mutually independent sealing plugs 64, inserted in respective receiving bores 40 to be sealed, only one of the sealing plugs in question being illustrated in FIG. 8. In contrast, retaining washer 61 is provided with openings 66 aligned with those bores 65 disposed in the core that communicate in normal operation with pressurized-fluid tank 1.

Finally, it is to be pointed out that the foregoing explanations of the specific exemplary embodiments relate to control and distribution units 5, or in other words to structural units in which functions for both control and distribution of the hydraulic fluid are integrated. Obviously all explained aspects can be applied in the same way to such hydraulic systems, also encompassed by the present invention, that either have only a control or only a distribution function, such cases therefore representing a pure control unit or a pure distribution unit.

We claim:

1. A hydraulic system for a high-pressure application, comprising a pressurized-fluid tank, a pressurized-fluid pump driven by a drive unit, at least one hydraulic load pressurized thereby and a control and/or distribution unit connected fluidically between the pressurized-fluid pump and the load, which control and/or distribution unit is provided with a housing and a core received therein and connected rigidly with the housing, which core bears with part of its surface in the region of a common, closed, cylindrical joint face with the housing on a corresponding inside face of a housing opening, surface groove-like flow ducts being provided on the core and/or the housing in the region of the joint face, and the pressurized-fluid pump being directly built onto the control and/or distribution unit in the region of a free first end face of the core, and wherein the pressurized-fluid pump projects at least partly or completely into the control and/or distribution unit, and wherein the pressurized-fluid pump is sealed relative to the housing of the control and/or distribution unit at a flange portion projecting into the housing of the control and/or distribution unit.

2. A hydraulic system according to claim 1, wherein the control and/or distribution unit further comprises a seat disposed on one end face of the core of the control and/or distribution unit, and the pressurized-fluid pump projects into the seat disposed at an end face of the core of the control and/or distribution unit is sealed relative to the core of the control and/or distribution unit at the circumference of the portion projecting into the seat.

3. A hydraulic system according to claim 1, wherein the housing of the control and/or distribution unit is provided on its second end portion opposite the pressurized-fluid pump with an annular shoulder, on which the pressurized-fluid container is fastened.

4. A hydraulic system according to claim 3, wherein the second end face of the core is retracted relative to the housing of the control and/or distribution unit, so that at least part of the volume of the pressurized-fluid tank is disposed adjacent to the second end face of the core inside the housing of the control and/or distribution unit or is formed by a space defined inside the housing of the control and/or distribution unit.

5. A hydraulic system according to claim 4, wherein a return-flow line placing the at least one load in communication with the pressurized-fluid tank, while passing directly through the inside of the housing of the control and/or distribution unit, opens into the part of the volume of the pressurized-fluid tank or space disposed inside the housing of the control and/or distribution unit.

6. A hydraulic system according to claim 1, wherein the control and/or distribution unit is provided with a second core, the two cores being at a distance from one another and the space bounded by the housing opening between the two cores forming the pressurized-fluid tank.

7. A hydraulic system according to claim 6, wherein there are provided, in the region of the joint face, relief channels disposed circumferentially on the core and/or housing at both ends outside the portion provided with flow ducts, which channels communicate with a return-flow bore opening into the pressurized-fluid tank.

8. A hydraulic system according to claim 7, wherein the return-flow bore is substantially centrally disposed in the core.

9. A hydraulic system according to claim 7, wherein the return-flow bore is a common return-flow bore, in which there is disposed a return-flow filter, the core being provided with radial bores, that place receiving bores disposed in the core and receiving valve devices in communication with the common return-flow bore.

10. A hydraulic system according to claim 9, wherein the core is provided with receiving bores extending in its longitudinal direction, in which bores there are received valve devices.

11. A hydraulic system according to claim 10, wherein there is provided, at one end face at least of the core, a common sealing and retaining device extending through a plurality of the receiving bores, comprising a large number of mutually independent sealing plugs inserted into the receiving bores and a common retaining washer securing them in position.

12. A hydraulic system according to claim 11, wherein the core is provided with receiving bores passing through it, extending transverse to its longitudinal direction, radially or tangentially, in which bores there are received valve devices.

13. A hydraulic system according to claim 12, wherein at least one of the surface groove-like flow ducts has a well-defined cross-sectional constriction.

14. A hydraulic system according to claim 13, wherein the surface groove-like flow ducts are indented into the surface of the core of the control and/or distribution unit.

15. A hydraulic system according to claim 13, wherein at least two of the surface groove-like flow ducts separated from one another in the region of the joint face communicate with one another constantly via a bore passing through the core.

16. A hydraulic system according to claim 15, wherein the housing of the control and/or distribution unit is provided with a shell portion surrounding the core at least in the circumference of the joint face and with at least one port block molded in one piece onto this.

17. A hydraulic system according to claim 16, wherein the port block is joined over only part of the length of the joint face to the shell portion, the housing of the control and/or distribution unit being provided with a stress-relief groove between the shell portion and the port block, at least in the region of its end faces.

18. A hydraulic system according to claim 16, wherein all electrically actuated or activated components of the control and/or distribution unit, such as all solenoid valves, are mounted in the port block, a manually actuated valve device being mounted on the port block.

19. A hydraulic system according to claim 18, wherein, in the region of the port block, there is disposed at least one angled bore, of which a partial portion is drilled from the housing opening.

20. A hydraulic system according to claim 19, wherein reinforcements of the housing, acting as the screwed coupling of the pressurized-fluid pump with the housing of the control and/or distribution unit, are set back relative to the associated end face of the housing.

21. A hydraulic system according to claim 20, wherein the housing of the control and/or distribution unit is manufactured from an extruded prefabricated blank.

22. A hydraulic system according to claim 20, wherein the housing of the control and/or distribution unit is manufactured from a cast blank.

* * * * *